United States Patent [19]

Kaiser et al.

[11] 4,157,176

[45] Jun. 5, 1979

[54] APPARATUS FOR PRECISELY STACKING TEXTILE PIECES OF SHEETLIKE FORM

[75] Inventors: Albrecht Kaiser, Vlotho-Uffeln; Rolf Heine, Rinteln, both of Fed. Rep. of Germany

[73] Assignee: Herbert Kannegiesser Kommanditgesellschaft, Vlotho, Fed. Rep. of Germany

[21] Appl. No.: 832,770

[22] Filed: Sep. 13, 1977

[30] Foreign Application Priority Data

Sep. 20, 1976 [DE] Fed. Rep. of Germany ..... 2642265

[51] Int. Cl.[2] ..... B65H 29/28; B65H 29/60

[52] U.S. Cl. ..... 271/64; 271/176; 271/184; 271/85

[58] Field of Search ..... 271/64, 85, 84, 184, 271/225, 176; 214/6 D, 6 DK; 198/436, 486

[56] References Cited

U.S. PATENT DOCUMENTS

| | | | |
|---|---|---|---|
| 2,257,469 | 9/1941 | Keil | 271/176 |
| 3,406,966 | 10/1968 | Walton | 271/176 |
| 3,747,920 | 7/1973 | Linkus | 271/85 |
| 3,891,204 | 6/1975 | Mager | 271/85 |

FOREIGN PATENT DOCUMENTS

| | | | |
|---|---|---|---|
| 1057576 | 2/1967 | United Kingdom | 271/64 |

*Primary Examiner*—Bruce H. Stoner, Jr.

*Attorney, Agent, or Firm*—Sughrue, Rothwell, Mion, Zinn and Macpeak

[57] ABSTRACT

A slip plate located at the discharge end of an endless band transport device is provided with apertures on both sides at the end remote from the transport device and a stop located at that edge between the apertures. Alternately operating clamping devices movable at right angles to the direction of movement of the textile pieces of the slip plate convey the textile pieces by clamping at the apertures to stacking tables to the right and left of the slip plate.

7 Claims, 5 Drawing Figures

APPARATUS FOR PRECISELY STACKING TEXTILE PIECES OF SHEETLIKE FORM

BACKGROUND OF THE INVENTION

1. Field of the Invention

This invention relates to apparatus for submitting pieces of textiles of sheetlike form, especially collar and cuff interfacings for dress shirts, and upon discharge of the pieces from a continuous running endless band transport device, and more particularly, to a device for stacking the textile pieces of sheetlike form as they are discharged from the transport device and cemented together.

2. Description of the Prior Art

One familiar device for cementing such textile pieces together employs a screen located at the end of the transport device on which cemented textile pieces of sheetlike form are transported for stacking of the conveyed pieces on a stacking table located in the line through which the transport device moves. For the stacking process, the screen may be moved in two directions which are at right angles to each other. The bars of the screen grip through a grating fastened to the stacking table. The grating on the stacking table serves as a buffer and strips textile pieces lying on the moving screen off of said screen, after which the textile pieces lie on the stacking table with one edge lying against the grating. This type of stacking is disadvantageous because, among other things, the textile pieces are not aligned mechanically in the stacking process, along the forward edge in the direction of transport and are laid precisely, one on top of the other. Laying the side edge of the textile pieces precisely one on top of the other is only possible to some extent if the textile pieces are placed on a predetermined spot on the transport device at the infeed side of the apparatus by the operating personnel. However, experience has shown that this does not always happen, and in fact the output of the operating personnel has been reduced recently when such did happen.

Furthermore, the conventional apparatus incorporating devices for stacking textile pieces of sheetlike form after being cemented together and lying on a transport device which operates as the transport device moves forward, is disadvantageous because these devices are comparatively long, and as a result, installing them in already-existing production lines is not always possible and also because the stacking of the textile pieces on the stacking table can only be observed from the service side of the apparatus by using supplementary contrivances such as mirrors.

The placement of slip plates or something similar at the end an endless band or endless belt continually-running transport device for the purpose of transferring textile pieces being conveyed by the transport device to an apparatus for stacking them, and using the slip plates, at the same time for actual stacking process is a familiar method of stacking.

Also familiar is the use of gripping devices for conveying collar interfacings for dress shirts to and from the surfaces where devices for cementing them operate, for example, gripping devices are normally of the type which are pressed down on the collar interfacing from above and the gripping devices are then transported to carry the collar interfacings along therewith.

The basic purpose of the present invention is to propose an apparatus of the type initially described in which the textile pieces of sheetlike form and being cemented together, which are lying on the transport device of the apparatus, are mechanically aligned during the stacking process, both along the forward edge in the direction of transport as the transport device is operating and also along one of the side edges at right angles to the side of the forward edge, and consequently the textile pieces may be stacked precisely one upon the other. Furthermore, the apparatus of the present invention is not substantially longer than an apparatus without a device for stacking the textile pieces that have been cemented together. Furthermore, it is possible to see the stacking table from the apparatus infeed and service sides without supplementary contrivances such as mirrors and to observe the stacking of the textile pieces directly on these tables.

SUMMARY OF THE INVENTION

The apparatus of the present invention is characterized by a slip plate which is placed at the end of the transport device with the slip plate having apertures on opposite sides at the end or edge remote from the transport device, and a locating stop at that edge between the apertures, as well as two clamping devices, each associated with a given aperture at one side and each being movable at right angles to the direction of movement of the articles, that is, the textile pieces on the slip plate. The clamping devices are employed to convey the textile pieces lying in the area of the slip plate aperture to the stacking tables to the same side of the slip plate as the aperture.

By such apparatus for stacking textile pieces of sheetlike form and being cemented together, that are lying on the transport device of this structure, it is possible to align the textile pieces mechanically during the process of stacking them both along the forward edge in the direction of transport by the transport device, and also along one of the edges at the side of that forward edge, and consequently, to stack them precisely one on top of the other. During the stacking process, the textile pieces are conveyed both in the direction of the apparatus transport device and also at right angles to that direction, in a predetermined manner. Consequently, the operating personnel for the apparatus no longer need to align the textile pieces of sheetlike form that are cemented together in such a precise manner as they are laid on the transport device, and this has a favorable effect with respect to their output.

Further, it is a result of the fact that the stacking tables are located laterally of the slip plate, the apparatus, in the first place, is not substantially longer than the apparatus without a stacking device which is an advantage when installing it in an already existing production line, and in the second place, the stacking tables and the stacking of the textile pieces on them can be observed from the infeed and service sides of the apparatus, and consequently no supplementary viewing contrivances such as mirrors are required. The number of operating personnel may also be reduced, and any troubles developing during operation of the apparatus may be readily spotted and quickly corrected.

Constructing and controlling the movable clamping devices in accordance with the subclaims is advantageous because, as a result, the clamping devices work perfectly even when performing large stacking jobs, that is, among other things, receiving textile pieces to be stacked that are lying over the area of the slip plate apertures, quickly and accurately conveying them to the side and laying them in the stacking locations.

Additional advantageous features of the apparatus of the present invention are illustrated by way of the construction of such apparatus as represented schematically in the drawings.

DESCRIPTION OF THE PREFERRED EMBODIMENT

Figure 2:
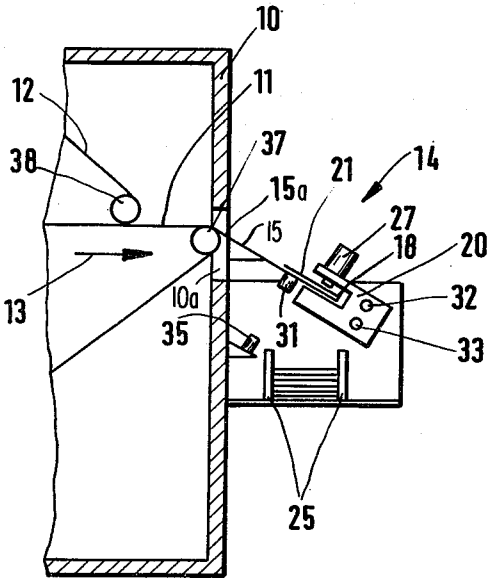
FIG. 2 is a cross-section of a portion of the apparatus at the discharge end of the same as shown in FIG. 1 taken about line A—A.

Turning to the drawings, there is shown the discharge portion of an apparatus for cementing textile pieces of sheetlike form, only a portion of which is represented in the drawings, and wherein the stacking device constituting the present invention forms a portion of such apparatus and is fastened to the frame 10 of that apparatus at the delivery end thereof.

Figure 1:
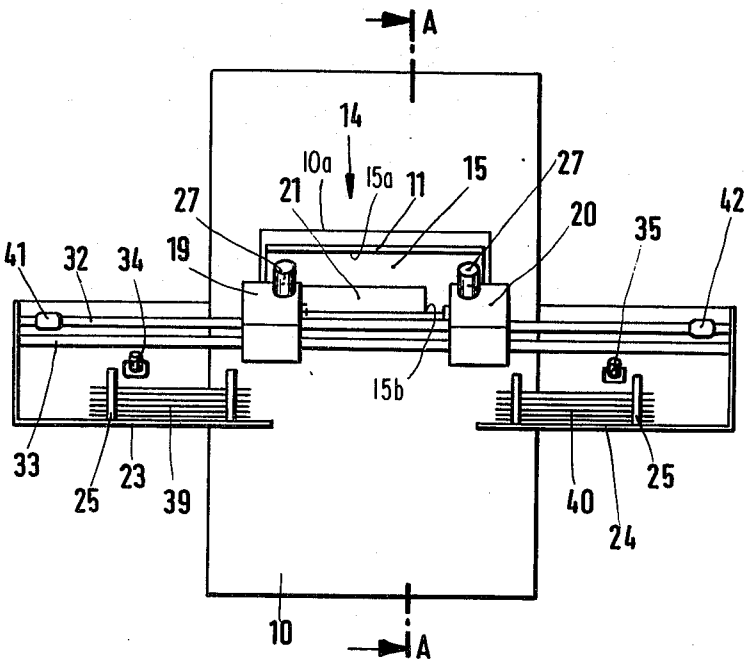
FIG. 1 is a side view of the apparatus employing the improved stacking device for textile pieces of sheetlike form constituting one embodiment of the present invention.

The stacking device 14 consists of a fixed slip plate 15 which is inclined and is mounted adjacent a window or opening 10*a* such that its upper edge 15*a* projects partially within the window 10*a* adjacent an endless band or belt transport device 11. The endless band transport device 11 is supported at this end by a guide roller 37, the endless band transport device 11 cooperating with a second endless band transport device 12 and having parallel, contacting runs for continuously propelling textile pieces between those runs in the direction of arrow 13, FIG. 2. The endless band transport device 12 has its one end guided over a guide roller 38 such that the lower run of its band contacts the upper run of the band of the endless band transport device 11. The bands of the endless band transport device 11 and 12 are conveyed at the same speed to convey in series fashion textile pieces between the runs with the textile pieces lying side by side for transport in the direction of arrow 13. The slip plate 15 carries at its lower end or edge 15*b* rectangular apertures or cut-outs as at 16 and 17 to the left and right side respectively, FIG. 3. Further, between the apertures 16 and 17 is a locating stop 18 such that the pieces as they move off the endless band conveyor device and slide down the slip plate 15 have their forward or leading edges abutting the locating stop 18, thereby specifically locating the lower end of each of the textile pieces such as pieces 21, 22, FIG. 3. The device of the present invention further incorporates clamping devices as 19 and 20 which are mounted on guide bars 32, 33, for movement at right angles to the direction of conveyor movement of the endless band conveyor devices 11 and 12, and thus at right angles to the movement of the pieces as they move down the slip plate 15. Conventional working cylinders (not shown) may be activated hydraulically or pneumatically to shift the clamping devices between extreme limits as between the position of clamping device 20, FIG. 1, and the same clamping device in FIG. 3.

Figure 4:
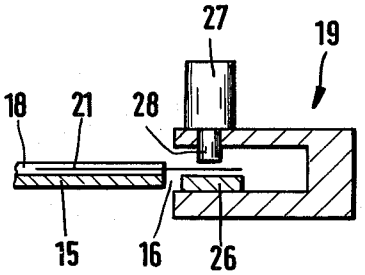
FIG. 4 is a sectional view of a clamping device of the type having a working cylinder pressing on a back pressure plate with the device in normal position.

Each of the clamping devices 19 and 20 is provided with a back-pressure plate 26, FIG. 4, in one embodiment of the invention, which cooperates with piston 28 of a working cylinder 27 which overlies that back-pressure plate and permits the clamping of textile pieces lying in the area of respective apertures 16 and 17 of the slip plate 15 and to then convey the textile pieces laterally, that is, to the right or the left to respective stacking tables 23 and 24, depending upon the position of the textile piece relative to the slip plate 15.

Figure 5:
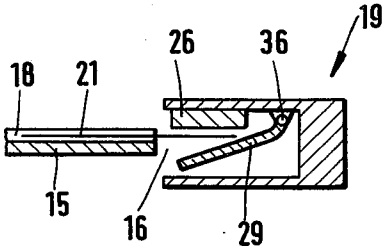
FIG. 5 is a sectional view of an alternate clamping device involving a clamping lever pressing against a back pressure plate, in normal position.

Alternately, the clamping devices 19 and 20 may take the form shown in FIG. 5, where instead of working cylinders, pivotable clamping levers 29 are mounted at one end for pivoting about a fulcrum as at 36 in a direction towards and away from the back-pressure plate 26 as carried by that device to clamp and release the portion of the textile piece which overlies a given aperture 16 or 17, the clamping lever being shiftable between clamping and unclamping position by conventional means such as pneumatic or hydraulic working cylinders, etc. (not shown).

In order to effect automated operation, the devices of the present invention are further provided with feeler devices 30 and 31 which are located adjacent the edge or end 15*b* of slip plate 15 for sensing the absence or presence of a textile piece located adjacent a given side of plate 15 and overlying a respective aperture 16 or 17. The feeler device 30 senses the presence of a textile piece such as piece 21 overlying aperture 16 in a position such that clamping device 19 may clamp the textile piece and convey it to stack 39 to the left, FIG. 3. It is also possible to locate such feeler devices above the slip plate 15 and also on the clamping devices 19 and 20, if desired. In that case, the feeler device will move with the clamping device as the clamping device moves to and from the stacking areas.

Stacking tables are provided at 23, 24 to the left and right of the slip plate 15. Additional feeler devices 34 and 35 which sense the forward edges of the textile piece are defined by the direction of movement of the clamping devices 19 and 20, control the movement of clamping devices 19 and 20, and effect the lifting of the work cylinders piston 28 while releasing the clamping lever 29 from their respective back-pressure plates 26, the feeler devices 34 and 35 comprising conventional photoelectric cells or the like. Obviously, other types of control are possible, for instance, the movement of the clamping devices 19 and 20 may be controlled by control elements 41 and 42 located on the guide bar 33 and responsive to direct contact by a leading edge of such clamping devices, for instance. The clamping devices 19 and 20 in non-clamping condition are moved from the stacking tables 23, 24 back to the slip plate 15 or to their normal positions after delivering and releasing a given textile piece such as pieces 21 and 22.

Holding posts 25 are provided to hold the textile pieces as at 39 and 40, stacked one on top of the other on the stacking tables 23 and 24, respectively, thus confining the textile pieces laterally.

The stacking device constituting the present invention operates as follows.

The textile pieces to be stacked which are supplied by the endless band transport devices 11 and 12 to the slip plate 15 are conveyed between the endless bands of such devices and are discharged on the slip plate 15 which pieces terminate transport movement in the direction of the movement of the endless band by contact with the locating stop 18 at the lower end of the slip plate 15. Since the operating personnel alternate between right and left in laying the textile pieces on the endless band transport device 11 at the infeed side, and at intervals between them with respect to the direction of movement as shown by arrow 13, the textile pieces are conveyed at the same rate of speed to the locating stop 18 and alternately to the areas of apertures 16 and 17 of slip plate 15. Thus, in FIG. 3, for example, textile piece 21 is shown with its leading edge at the locating stop 18 and having a portion of the textile piece overlying the area of the aperture 16 of the slip plate 15 while textile piece 22 is still shown as lying on the endless band of the endless band transport device 11. Further, the textile piece 22 is shown on the right of that endless band and thus will be aligned with aperture 17 of the slip plate 15.

In the case of the textile pieces of the illustrated embodiment, the size of those textile pieces 21 and 22 which are in terms of length larger than half the width of the endless band transport devices 11 and 12 and of the slip plate 15, limits the operation to one in which the clamping devices 19 and 20 alternate. However, if the textile pieces to be cemented and stacked are smaller than half the width of the endless band of the transport devices 11 and 12, they can naturally be laid on both the right and left sides of the endless band of the transport device 11 in lateral alignment. In that case, the clamping devices 19 and 20 of the stacking devices move in the direction of the stacking tables 23 and 24 simultaneously and back to the slip plate 15, at the same time.

Figure 3:
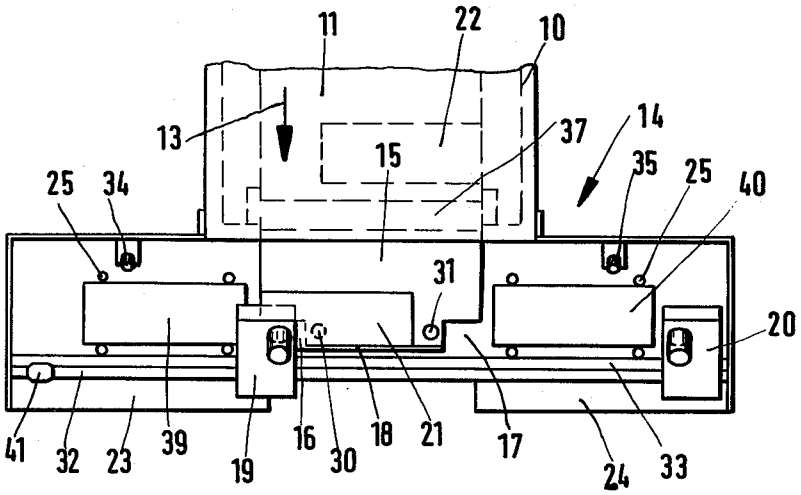
FIG. 3 is a plan view of the rear portion of the apparatus of FIGS. 1 and 2 in which one of the two clamping devices is at normal position and the other is in stacking position.

In the illustrated embodiment, the textile piece 21, FIG. 3, lying over the area of aperture 16 of the slip plate 15 is grasped by the clamping device 19 which is located at that moment in the area of the aperture 16 by effecting depression of the working cylinder pistons 28 against the back pressure plate 26 such that the textile piece 21 is clamped between the back-pressure plate and the piston 28. When this has occurred, the clamping device 19 is moved in the direction of the stacking table 23 and the textile piece 21 is thereby conveyed to a point above the textile pieces 39 already stacked on the stacking table 23 and placed on top of them by the clamping device. At about the same time, the second clamping device 20 in the stacking location moves back to the normal position or the area of aperture 17 of slip plate 15, thus the clamping device 20 can grasp or clamp the next textile piece 22, which in FIG. 3 is still lying on the endless band of the transport 11. This occurs after the next textile piece 22 has been conveyed to the area of aperture 17 of the slip plate 15 and then the clamping device 20 conveys it to stacking table 24 and lays it on top of the textile pieces 40 which are already stacked there.

In the course of this process, with a view of obtaining precise stacking in the area provided for that purpose on the stacking tables 23 and 24 and delimited by the holding posts 25 and to stacking textile pieces on the pieces 39 and 40 already stacked on the stacking tables 23 and 24, respectively, to cover them exactly, the textile pieces 21 and 22 to be stacked are first aligned by the locating stop 18 of slip plate 15 with respect to their forward edges in terms of the direction of movement of the apparatus, arrow 13, and then the alignment of one of the side edges of the textile pieces 21 and 22 is accomplished by controlled movement of the clamping devices 19 and 20 to the position where feelers 34 and 35 sense the leading edges of the textile pieces in the direction of movement of the clamping devices as they move into proper position with respect to the stack of textile pieces as at 39, 40.

While the invention has been particularly shown and described with reference to a preferred embodiment thereof, it will be understood by those skilled in the art that various changes in form and details may be made therein without departing from the spirit and scope of the invention.

What is claimed is:

1. In an apparatus for cementing textile pieces of sheetlike form having a feeding end and an in-line, remote discharging end, and having a continuously running transport device for discharging cemented textile pieces in serial fashion at said discharging end, the improvement comprising a stacking device for stacking said textile pieces of sheetlike form as discharged from the transport device, said stacking device comprising:

a downwardly inclined slip plate located at the discharge end of the transport device and receiving textile pieces which move along the surface of the slip plate, a locating stop at the end of the slip plate remote from said transport device, apertures on the sides of said slip plate at the end carrying said locating stop, a pair of clamping devices movable at right angles to the direction of textile piece movement on said slip plate between positions aligned with said slip plate apertures and positions laterally displaced therefrom, and comprising means for grasping portions of said textile pieces lying in the area of the aperture and for conveying said textile pieces to stacking tables to the right and left of said slip plate, said stacking tables projecting laterally beyond said continuously running transport device; whereby, articles stacked thereon are directly visible from said feeding end of the apparatus remote from the discharging end.

2. The apparatus as claimed in claim 1, wherein each clamping device comprises a back-pressure plate and a working cylinder having a piston depressable into contact with said back-pressure plate, and wherein said piston in release position permits the portion of the textile piece within the area of the aperture to enter a gap between the piston and said back-pressure plate.

3. The apparatus as claimed in claim 1, wherein each of said clamping devices comprises a back-pressure plate and a clamping lever depressable in contact with said back-pressure plate and being mounted such that said clamping lever in unclamped position defines a gap with respect to said back-pressure plate which receives the portion of said textile piece lying within the area of a respective aperture.

4. The apparatus as claimed in claim 1, further comprising feeler devices located at the end of the slip plate adjacent said apertures for sensing the presence of a leading edge of a textile piece in terms of its direction of movement provided by said transport device for controlling operation of said clamping device and the movement of the clamping device in the direction of the stacking table.

5. The apparatus as claimed in claim 4, further comprising additional feeler devices positioned in the path of movement of said textile pieces from said slip plate towards said stacking tables for feeling the forward edge of the textile pieces in terms of the direction of movement from said slip plate laterally towards said stacking tables and for terminating movement of said clamping devices and release of the same.

6. The apparatus as claimed in claim 1, further comprising at least one guide bar extending at right angles to the direction of movement of said conveying device adjacent said slip plate and means for slidably mounted said clamping devices on said at least one guide bar.

7. The apparatus as claimed in claim 6, further comprising control elements located on said at least one guide bar on opposite sides of said slip plate and remote from the sides of said slip plate for sensing the position of said clamping devices as they move during transport of the textile pieces towards said stacking tables and to effect release of said textile pieces by said clamping devices to effect stacking of the textile pieces at said stacking tables.

* * * * *